US009790077B2

(12) United States Patent
Promoli

(10) Patent No.: US 9,790,077 B2
(45) Date of Patent: Oct. 17, 2017

(54) CLOSURE FOR THE CHARGING HOLE OF A LIQUID CONTAINER

(71) Applicant: Erwin Promoli, Röhrmoos (DE)

(72) Inventor: Erwin Promoli, Röhrmoos (DE)

(73) Assignee: Erwin Promoli (DE)

( * ) Notice: Subject to any disclaimer, the term of this patent is extended or adjusted under 35 U.S.C. 154(b) by 0 days.

(21) Appl. No.: 14/910,906

(22) PCT Filed: Aug. 9, 2013

(86) PCT No.: PCT/EP2013/066745
§ 371 (c)(1),
(2) Date: Feb. 9, 2016

(87) PCT Pub. No.: WO2015/018458
PCT Pub. Date: Feb. 12, 2015

(65) Prior Publication Data

US 2016/0194191 A1 Jul. 7, 2016

(51) Int. Cl.
*B67D 1/08* (2006.01)

(52) U.S. Cl.
CPC ..... *B67D 1/0808* (2013.01); *B67D 1/0802* (2013.01); *B67D 1/0807* (2013.01); *B67D 1/0835* (2013.01); *B67D 2001/0822* (2013.01)

(58) Field of Classification Search
CPC .. B67D 1/0808; B67D 1/0835; B67D 1/0807; B67D 1/0802; B67D 2001/0822
USPC ..... 222/83, 541.2
See application file for complete search history.

(56) References Cited

U.S. PATENT DOCUMENTS 2,851,201 A * 9/1958 Poitras ..... A61J 1/1406 215/DIG. 3
7,380,683 B1 * 6/2008 Oberhofer ..... B65D 51/1683 220/203.07

FOREIGN PATENT DOCUMENTS

| | | |
|---|---|---|
| FR | 2138685 A1 | 1/1973 |
| FR | 2736329 A1 | 1/1997 |
| GB | 210832 | 2/1924 |
| WO | 01/14242 A1 | 3/2001 |

OTHER PUBLICATIONS

Search report for International Patent Application No. PCT/EP2013/066745; May 21, 2014.

* cited by examiner

*Primary Examiner* — Donnell Long
(74) *Attorney, Agent, or Firm* — Barnes & Thornburg LLP

(57) ABSTRACT

The closure serves to tightly close the charging hole of a liquid container. It enables the container to be punctured at the charging hole. The closure is provided with a pressure equalizing valve. A tapping bush of an elastic material has a an axial puncturing channel and an axial pressure equalizing channel disposed adjacent to, and spaced from, one another, puncturing channel and the pressure equalizing channel terminating at an end face of the tapping bush next to one another. A flap is integrally articulated to the tapping bush, the flap in its closed position covering the end face, closing the open ends of the channels in a splash-water tight manner, and blocking the pressure equalizing channel in a pressure tight manner. The flap can be manually tilted up and down to unblock the pressure equalizing channel more or less, thereby actuating the pressure equalizing valve.

15 Claims, 4 Drawing Sheets

CLOSURE FOR THE CHARGING HOLE OF A LIQUID CONTAINER

CROSS REFERENCE AND PRIORITY

This patent application is a U.S. National Phase of International Patent Application No. PCT/EP2013/0066745, filed 9 Aug. 2014, the disclosure of which are incorporated herein by reference in their entirety.

BACKGROUND

Disclosed embodiments relate to a closure for the charging hole of a liquid container having a tapping bush made of resilient material and seally fitting into the charging hole.

SUMMARY

Disclosed embodiments relate to a closure for the charging hole of a liquid container having a tapping bush made of resilient material and seally fitting into the charging hole. The tapping bush has an axial puncturing channel at which the container may be tapped by means of the puncturing pipe of a tapping device, at which time the tapping bush is sealed by the puncturing pipe. The tapping bush is provided with a manually operable pressure equalising valve for blocking and unblocking a pressure equalising channel arranged between the head space of the container above the liquid level therein and atmosphere.

BRIEF DESCRIPTION OF THE FIGURES

FIGS. 1 to 5 show the closure with the flap in its closed seal position wherein: FIG. 1 is a perspective view, FIG. 2 is a side view, FIG. 3 is a plan view from above, FIG. 4 is a plan view from below, and FIG. 5 is a diametric cross-sectional view.

FIGS. 6 to 10 show the flap in its open pressure equalising position, wherein FIG. 6 is a perspective view, FIG. 7 is a side view, FIG. 8 is a plan view from above, FIG. 9 is a plan view from below, and FIG. 10 is a diametric cross-sectional view.

DETAILED DESCRIPTION

Figure 1:
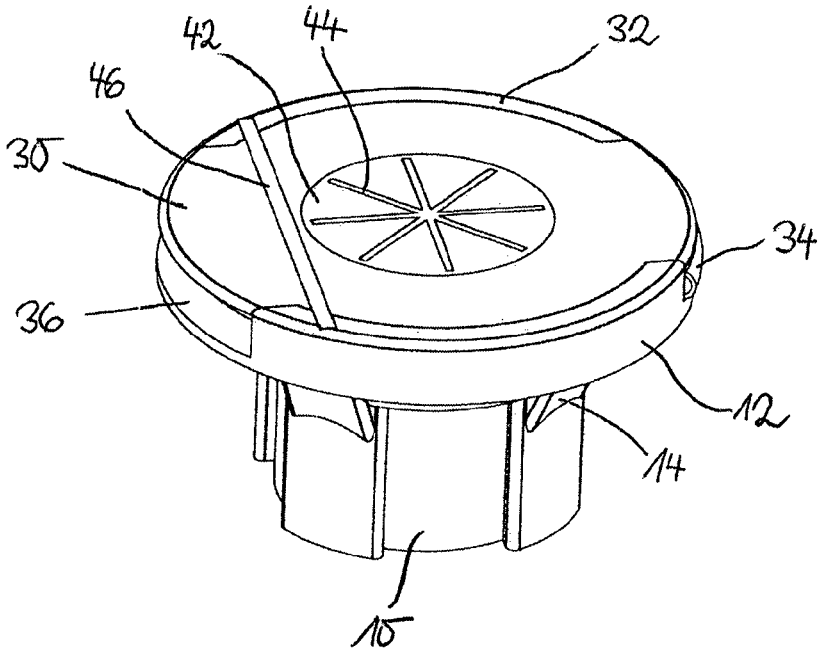

Disclosed embodiments relate to a closure for the charging hole of a liquid container having a tapping bush made of resilient material and seally fitting into the charging hole. The tapping bush has an axial puncturing channel at which the container may be tapped by means of the puncturing pipe of a tapping device, at wgich time the tapping bush is sealed by the puncturing pipe. The tapping bush is provided with a manually operable pressure equalising valve for blocking and unblocking a pressure equalising channel arranged between the head space of the container above the liquid level therein and atmosphere.

A closure of this type is known from WO 2001/014242 A1. It serves to tightly close the charging hole of a liquid container. Examples of such containers include barrels, kegs (party kegs) and cans filled with pressurised or unpressurised liquids, in particular beverages. Specifically concerned are party kegs for beer. The closure is a unit completely supplied to the bottler. It is pressed into the charging hole of the container at the end of the filling step, in deforming the tapping bush.

The tapping bush closure of WO 2001/014242 A1 is designed to be tapped by the puncturing pipe of a tapping device. The tapping bush of the closure has an axial puncturing channel which is closed by a tap plug fitted therein. For tapping, the puncturing pipe of the tapping device is inserted into the puncturing channel, and the tap plug is pushed into the container. The tapping bush is sealed by the puncturing pipe.

Drawing liquid from the container, however, does not necessarily require tapping at the charging hole. Relevant containers often have a lower discharge opening separate from the charging hole. The discharge opening may be a tapping hole that is tapped by a tapping device or the like, or a faucet integrated in the container.

In WO 2001/014242 A1, the closure for the charging hole is provided with a pressure equalising valve at the top wall of the container. A pressure equalising channel extends through the tapping bush between the head space of the container above the liquid level therein and atmosphere. The pressure equalising channel is blocked prior to use. It can be unblocked, re-blocked, again unblocked etc. by manually rotating the pressure equalising valve.

In beer kegs, a considerable excess pressure my build up due to shocks occurring during shipping and/or heating with the result that, at the beginning, almost only froth will be drawn. It is recommendable carefully to diminish this excess pressure via the pressure equalising valve prior to the first tapping.

When unpressurised liquid is drawn from the lower discharge opening, a vacuum is generated in the container above the liquid level. The container can be aerated by means of the pressure equalising valve to diminish this vacuum.

In the tapping bush closure of WO 2001/014242 A1, the tap plug located within the puncturing channel also constitutes the valve member of the rotary pressure equalising valve. The pressure equalising channel is a radial bore which penetrates the tapping bush laterally and leads to the inner jacket of the puncturing channel. Depending on the rotary position of the tap plug, the opening of the pressure equalising channel into the puncturing channel is blocked or more or less unblocked. Pressure equalisation then takes place through the puncturing channel.

The tapping bush closure of WO 2001/014242 A1 has a structure including at least two parts. The rotary tap plug is a part separate from the tapping bush.

Multiple part tapping bush closures for the charging hole of a liquid container, which can be punctured and include a pressure equalising valve, are also known from DE 10 2006 056 062 A1, DE 100 00 335 A1 and DE 199 52 473 C2.

In the closure of DE 10 2006 056 062 A1, a sleeve is screwed into the central opening of the tapping bush, which forms the puncturing channel for the puncturing pipe of a tap device. The inner end of the tapping bush is pressure-tightly closed by a wall, the rim of which is connected to the tapping bush via a predetermined breaking portion. The wall punctured by the puncturing pipe. Alternatively, the wall can be ruptured by screwing the sleeve to cause pressure equalisation. The puncturing channel is covered outside of the sleeve by a puncturable diaphragm.

The tapping bush closure of DE 10 2006 056 062 A1 has a structure including at least two parts. The rotary sleeve is a part separate from the tapping bush.

In the closure of DE 100 00 335 A1, the tapping bush is provided with a seal which serves as a protection against contamination and a visible indication of the intactness of the closure, but may also be used for closing the container in a gas-tight and pressure tight manner.

The closure of DE 199 52 473 C2 includes at least three parts.

It is the object of the invention to devise a closure for the charging hole of a fluid container which can be punctured like the known closures and is provided with a pressure equalisation valve, but is of a rather less expensive structure and intuitively easier to operate, and satisfies highest hygienic requirements.

In a closure which meets this object, the puncturing channel and the pressure equalising channel of the tapping bush are spatially and functionally separated. The pressure equalising channel extends axially through the tapping bush laterally of the puncturing channel and spaced therefrom and opens at an end face of the tapping bush laterally of, and spaced from, the puncturing channel. The tapping bush is provided with an integrated hinged flap which, in a downward tilted closing position, covers the end face, closes the openings of the puncturing channel and the pressure equalising channel in a splash water tight manner and blocks the pressure equalising channel in a pressure tight manner, i.e. impermeable to gas and resistant to pressure. The flap can be manually tilted up and down to unblock the pressure equalising channel more or less, thus operating the pressure equalising valve.

The closure in accordance with the disclosed embodiments may be manufactured integrally in one step by two or three component plastic injection moulding, so-called assembling injection moulding. No special step is required for assembling plastic parts which are initially produced separately. This results in advantages as to hygiene and cost. The integral structure of the closure is made possible by providing the pressure equalising valve on the flap. Covering the openings of the puncturing channel and the pressure equalising channel by the flap serves hygienic purposes. Entry of splash water and pollution is obviated. The operation of the pressure equalising valve by tilting the flap is intuitively convenient for the user because the tapping lever of a conventional faucet is operated in the same way. The flap offers a long lever for effortless and smooth operation of the pressure equalising valve.

Optionally, the tapping bush is substantially axially symmetric. It has a tapered body with an outward projecting flange by which it rests on the container wall in which the charging hole of the container is located. The puncturing channel is a channel passing centrally though the tapping bush. The pressure equalising channel extends through the flange of the tapping bush and terminates short of the flange at the periphery of the tapered body of the tapping bush.

Optionally, the flap has an integral plug-type valve cross-piece which fits into the pressure equalising channel and blocks the same in a pressure tight manner when the flap is tilted downward. By an upward rotation of the flap, the valve cross-piece can be pulled out of the pressure equalising channel to open a flow path for pressure equalisation.

Optionally, the valve cross-piece is of a conical shape which serves to regulate the pressure by actuation of the pressure equalising valve.

Optionally, the pressure equalising channel and the valve cross-piece fitted therein have an elongate oval cross-section extending in the circumferential direction.

Optionally, the flap is articulated to a side of the tapping bush by an integrated hinge close to the pressure equalising channel so that the latter is located between the integrated hinge and the puncturing channel. The flap thereby forms a single-arm lever with a long lever arm for actuating the pressure equalising valve.

Optionally, the flap is provided with a seal which is conspicuously destroyed by the first upward rotation of the flap. Specially envisaged is an adhesive bond which not only indicates the integrity of the closure in the sense of an originality seal but also secures the closure against the application of force and inadvertent maloperation.

Optionally, the closure is manufactured by multiple-component plastic injection moulding, specifically two-component plastic injection moulding from a hard component and a soft seal component, or three-component plastic injection moulding from a hard component, a soft seal component, and a colour component having a colour different from the afore-mentioned components. The seal consists of the colour component.

Optionally, the interior of the tapping bush is closed in a pressure tight manner by an integral bottom which can be punctured by the puncturing pipe of a tapping device.

Optionally, the rim of the bottom has a predetermined breaking location with webs of the hard component and intervening parts of the seal component. The presence of the two plastic components at the predetermined breaking location ensures small effort in puncturing the bottom and a safe gas-tight and pressure-resistant tightness of the predetermined breaking location.

Optionally, the flap is provided with a diaphragm which, in the downward tilted closing position of the flap, lies in front of the opening of the puncturing channel and can be punctured by the puncturing pipe of a tapping device. The diaphragm seals the puncturing channel against splash water and contamination. It tells the user where the container may be punctured, irrespective of any pressure equalisation due to actuation of the flap.

Optionally, the puncturing channel is substantially cylindrical, notwithstanding an annular bead or a plurality of axially offset annular beads that may be provided on the jacket of the puncturing channel. Preferably, the diaphragm on the flap is circular with a diameter corresponding to the clear width of the puncturing channel.

Optionally, the diaphragm is provided with radially extending predetermined breaking locations equally spaced along the circumference.

Optionally, the rim of the diaphragm has a predetermined breaking location with webs of the hard component and intervening parts of the seal component. The presence of the two plastic components at the predetermined breaking location ensures small effort in puncturing the diaphragm and a good tightness of the predetermined breaking location.

The bottom at the inner end of the tapping bush and the diaphragm on the flap are preferably designed to tear open without breaking away when punctured. Its fragments get caught thereby guiding the puncturing pipe without impairing its seal. Nothing, absolutely nothing, is pushed into the liquid container. This may be preferred for hygienic reasons.

Optionally, the closure is integrally manufactured in one step by three-component assembling injection moulding. The closure is moulded form the hard component and the seal component with the flap in its open position, and the flap of the closure, while still in the injection moulding tool, is closed and coated with the colour component. While the injection moulding tool used therefore is rather expensive the mass production of the closure is cost-efficient and definitively very hygienic.

Figure 2:
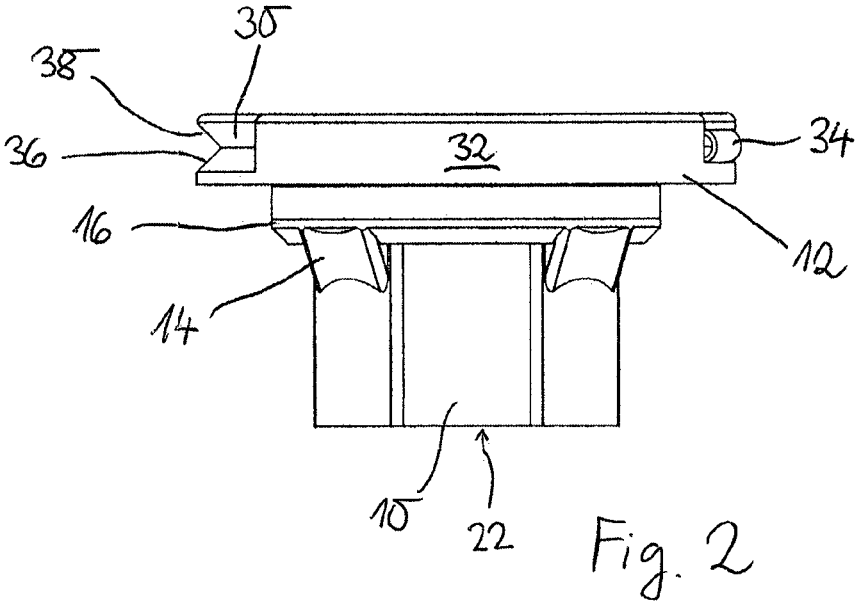
Figure 3:
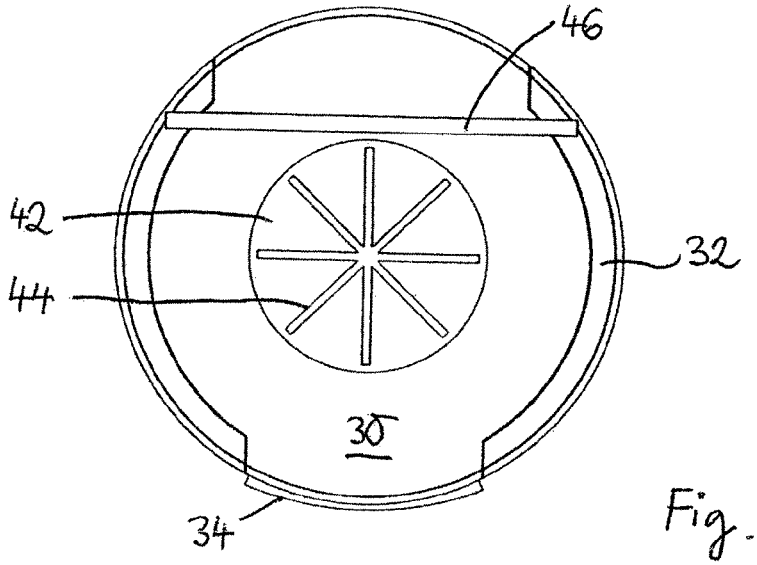
Figure 4:
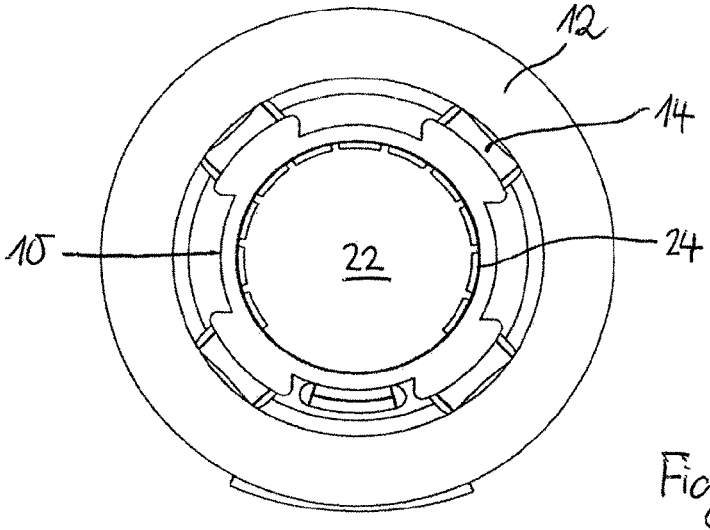
Figure 5:
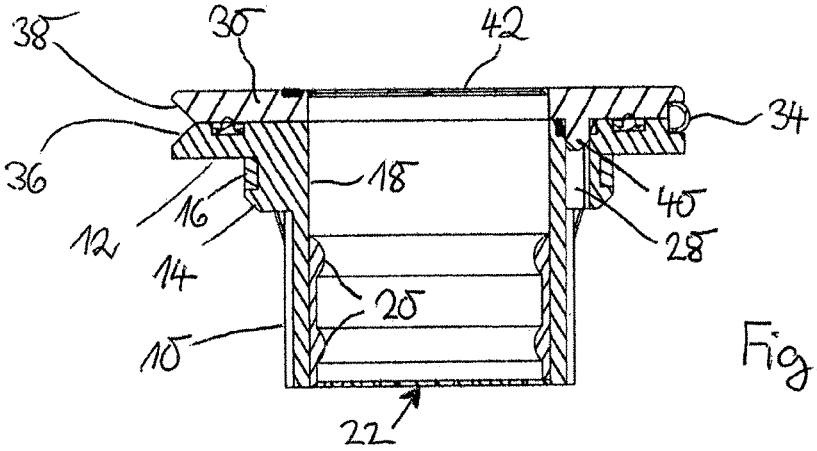
Figure 6:
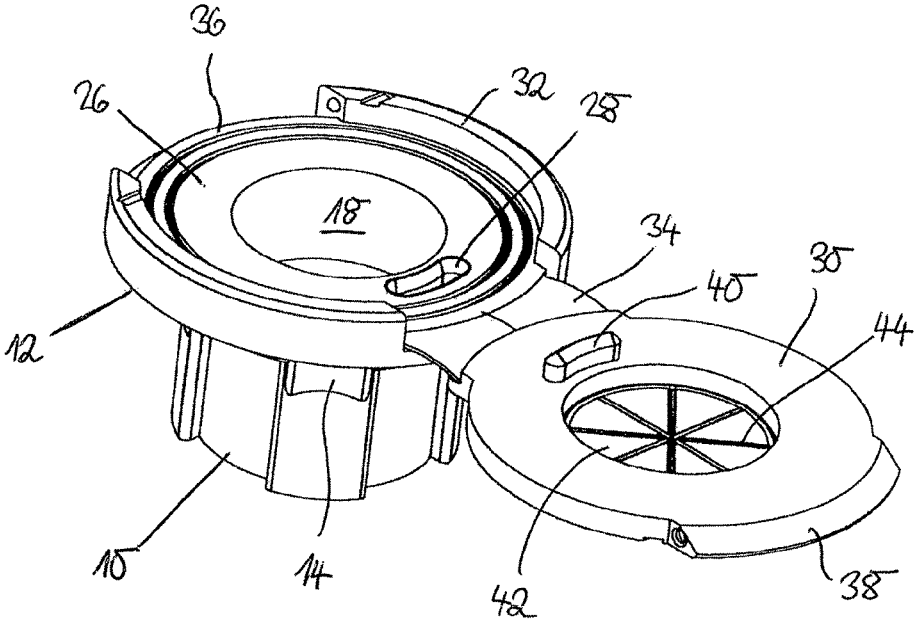
Figure 7:
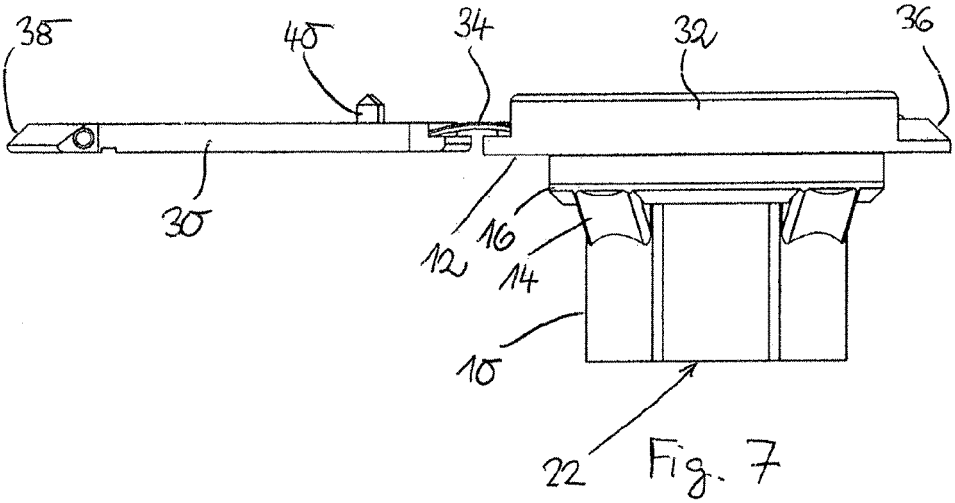
Figure 15:
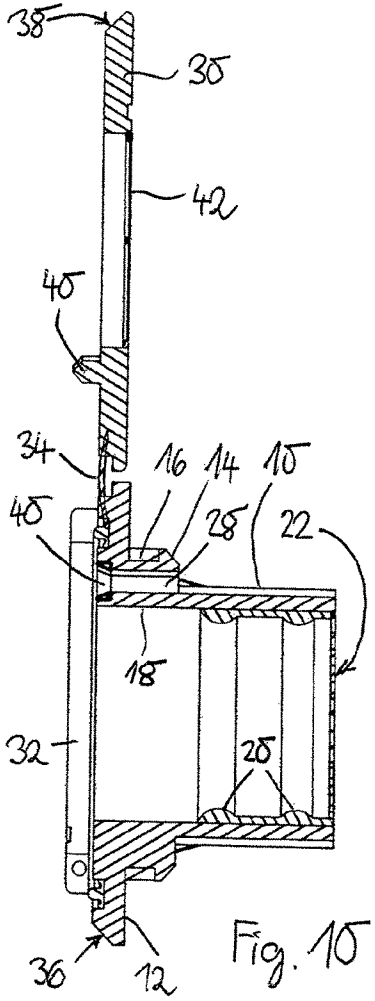
Figure 9:
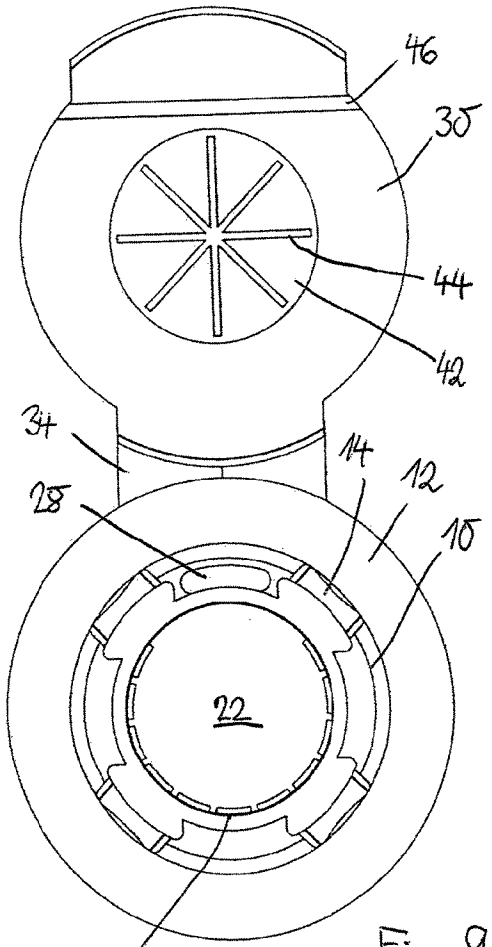
Figure 8:
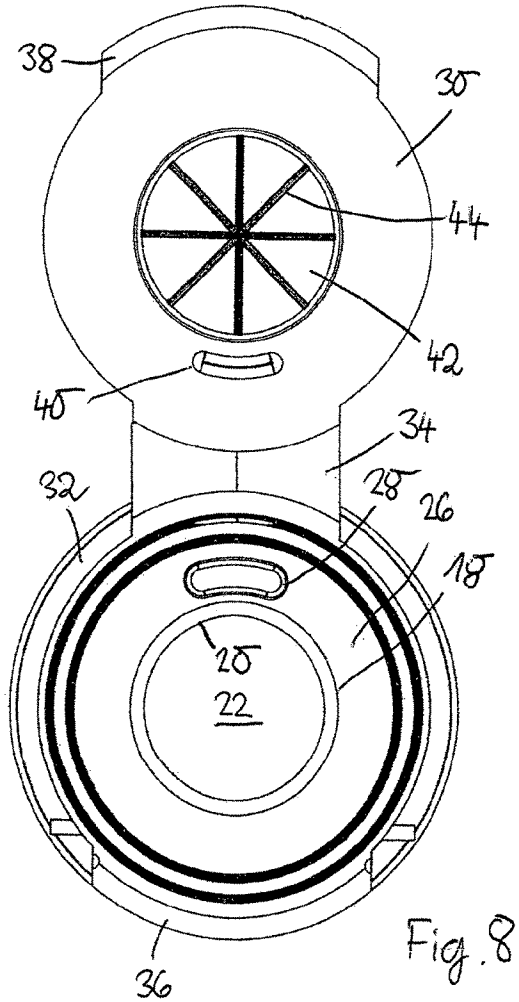

Disclosed embodiments will now be explained below with reference to the drawings. What is shown is a closure for the charging hole of a liquid container in which pressure equalisation takes place by operating a flap. FIGS. 1 to 5 show the closure with the flap in its closed seal position wherein: FIG. 1 is a perspective view, FIG. 2 is a side view, FIG. 3 is a plan view from above, FIG. 4 is a plan view from below, and FIG. 5 is a diametric cross-sectional view. FIGS. 6 to 10 show the flap in its open pressure equalising position, wherein FIG. 6 is a perspective view, FIG. 7 is a side view, FIG. 8 is a plan view from above, FIG. 9 is a plan view from below, and FIG. 10 is a diametric cross-sectional view.

The closure in accordance with the disclosed embodiments serves to tightly close the charging hole of a container filed with liquid. Examples of such containers include barrels, kegs (party kegs) and cans in which beverages are filled without pressure or under pressure. Specifically concerned are party kegs for beer which are conventionally made of sheet metal and have a charging hole in the top wall.

A part of the closure in accordance with the disclosed embodiments is a tapping bush of an elastic material, which may be described as substantially axially symmetric. The tapping bush has a tapered body 10 with a radially outward projecting circumferential flange 12.

Upon filling a party keg, the tapping bush is pressed under elastic deformation, with the tapered body 10 leading, into the charging hole in the top wall of the party keg until the flange 12 abuts the top wall. The outer jacket of the tapered body has circumferentially equally spaced ramps 14 which widen in the pressing direction of the tapping bush. Between the ramps 14 and the flange 12 of the tapping bush, the diameter of the tapping bush is reduced to form an annular groove 16 which catches the rim of the charging hole.

The puncturing pipe of a tapping device may be inserted into a nearly circular-cylindrical puncturing channel 18 which extends axially through the centre of the tapping bush, to puncture the container and draw liquid therefrom.

On the cylindrical jacket wall of the puncturing channel 18, the tapping bush has two axially offset circumferential beads 20 projecting inward into the cylindrical opening of the puncturing channel 18. The circumferential beads 20 serve to guide and seal the puncturing pipe.

The inner end of the puncturing channel 18 is closed by a bottom 22 which is formed integrally with the tapered body 10 of the tapping bush and constitutes the inner end thereof. The bottom 22 withstands the internal pressure of the container.

The outer periphery of the bottom 22 is provided with a predetermined breaking location 24 which extends over about three quarters of the bottom periphery. On tapping, the bottom 22 is punctured and torn open by the puncturing pipe of the tapping device.

The puncturing channel 18 has an open outer end at a planar end face 26 of the flange 12. Laterally of the mouth of the puncturing channel 18 and spaced therefrom, FIGS. 6 and 8 show a separate pressure equalising channel 28 which extends through the flange 12 and terminates immediately below the annular groove 16 for the rim of the container at the outer periphery of the tapered body 10. The pressure equalising channel 28 extends axially throughout the length and laterally of the puncturing channel 18. It connects the head space of the container above the liquid level thereof with the atmosphere.

The pressure equalising channel 28 is axially symmetric and has an elongate oval cross-section extending in the circumferential direction.

A flap 30 is formed integrally with the tapping bush, the flap being adapted to cover the end face 26 of the flange 12 and close the open ends of the puncturing channel 18 and the pressure equalising channel 28 in a splash-water tight manner.

The flap 30 is a planar circular disc. In the closed position, the flap 30 fits and latches between retaining webs 32 which project outward from the end face 26 of the flange 12 at the periphery there of.

At the height of the flange 12, the flap 30 is laterally connected to the tapping bush via an integral hinge 34.

On the side opposite to the integral hinge 34, the flange 12 and the flap 30 have chamfers 36, 38 which form a circumferential notch of triangular cross-section when the flap 30 is closed. The user will grip the flap 30 from below at the notch for tilting the flap upward.

The integral hinge 34 of the flap 30 is aligned in the circumferential directional with the pressure equalising channel 28. The pressure equalising channel 28 is adjacent to the integral hinge 34, more exactly between the integral hinge 34 and the puncturing channel 18.

Opposite to the pressure equalising channel 28, on the other side of the integral hinge 34, a plug-type valve cross-piece 40 is formed integrally with the inner side of the flap. The valve cross-piece 40 is substantially a complementary mirror image of the mouth of the pressure equalising channel 28. However, it engages the mouth with a taper that widens the latter. The valve cross-piece 40 is axially symmetric and has an elongate oval cross-section extending in the circumferential direction. When the flap 30 is closed, the valve cross-piece 40 blocks the pressure equalising channel 28 in a pressure tight manner.

A circular diaphragm 42 is formed in the centre of the flap 30, the diameter of the diaphragm corresponding to the clear width of the puncturing channel 18. The diaphragm 42 is provided with circumferentially equally spaced, radially extending predetermined breaking locations 44. On tapping, the diaphragm 42 is punctured and torn open by the puncturing pipe of the tapping device.

Prior to the first use, the flap 30 takes a downward tilted closed position in which it latches with the flange 12 of the tapping bush, covers the open ends of the puncturing channel 18 and the pressure equalising channel 28, and blocks the pressure equalising channel 28 with the valve cross-piece 40 engaging the latter. In this position, the flap 30 is fixed by a seal 46 which is conspicuously destroyed when the flap 30 is tilted upward for the first time.

The seal 46 is formed by a straight narrow strip of material which straddles the flap 30 on the side remote from the integral hinge 34 along a secant line parallel to the axis of the integral hinge 34.

By carefully tilting the flap 30 upward, the valve cross-piece 40 is progressively pulled out of the mouth of the pressure equalising channel 28 and the flow path for pressure equalisation is gradually opened. By tilting the flap downward, the flow path is progressively restricted and finally blocked. Due to the long lever arm of the flap 30, the tilting movement for pressure equalisation is smooth and requires little effort.

The diaphragm 42 at the flap 30 makes it easy for the user to recognise where the container can be punctured by the tapping device, irrespective of any pressure equalisation by the flap 30.

LIST OF REFERENCE NUMBERS

10 Tapered body
12 Flange
14 Ramp
16 Annular groove
18 Puncturing channel
20 Annular bead

22 Bottom
24 Predetermined breaking location
26 End face
28 Pressure equalising channel
30 Flap
32 Retaining web
34 Integrated hinge
36 Chamfer of the flange
38 Chamfer of the cap
40 Valve cross-piece
42 Diaphragm
44 Predetermined breaking location
46 Seal

The invention claimed is:

1. A closure for a charging hole of a liquid container having a tapping bush of an elastic material seally fitting into the charging hole and including an axial puncturing channel at which the container is adapted to be punctured by the puncturing pipe of a tapping device, wherein the tapping bush is sealed at a puncturing pipe and is provided with a manually operable pressure equalising valve for blocking and unblocking a pressure equalising channel between the head space of the container above the liquid level therein and atmosphere, wherein the pressure equalising channel extends axially through the tapping bush laterally of the puncturing channel and spaced therefrom and opens at an end face of the tapping bush laterally of, and spaced from, the puncturing channel, and that the tapping bush is provided with an integrated hinged flap which, in a downward tilted closing position, covers the end face, closes open ends of the puncturing channel and the pressure equalising channel in a splash water tight manner, and blocks the pressure equalising channel in a pressure tight manner, and which is adapted to be manually tilted up and down to unblock the pressure equalising channel more or less, thus operating the pressure equalising valve.

2. The closure of claim 1, wherein the tapping bush is substantially axially symmetric and has a tapered body with an outward projecting flange by which the tapping bush rests on the container wall in which the charging hole of the container is located, and wherein the puncturing channel is a channel passing centrally though the tapping bush, and that the pressure equalising channel extends through the flange of the tapping bush and terminates short of the flange at the periphery of the tapered body.

3. The closure of claim 1, wherein the flap has an integral valve cross-piece which fits into the pressure equalising channel and blocks the same in a pressure tight manner when the flap is tilted downward, and which is adapted to be pulled out of the pressure equalising channel by tilting the flap upward.

4. The closure of claim 3, wherein the valve cross-piece is conical.

5. The closure of claim 3, wherein the pressure equalising channel and the valve cross-piece fitted therein have an elongate oval cross-section extending in the circumferential direction.

6. The closure of claim 1, wherein the flap is articulated by an integrated hinge to a side of the tapping bush close to the pressure equalising channel in such a way that the latter is located between the integrated hinge and the puncturing channel.

7. The closure of claim 1, wherein the flap is provided with a seal which is adapted to be conspicuously destroyed by the first upward rotation of the flap.

8. The closure of claim 1, wherein the closure is manufactured by two-component plastic injection moulding from a hard component and a soft seal component, or three-component plastic injection moulding from a hard component, a soft seal component, and a colour component having a colour different from the hard component and the sealing component, wherein the seal consists of the colour component.

9. The closure of claim 1, wherein an inner end of the tapping bush is closed in a pressure tight manner by an integral bottom which is adapted to be punctured by the puncturing pipe.

10. The closure of claim 9, wherein a rim of the bottom has a predetermined breaking location with webs of a hard component and intervening parts of a seal component.

11. The closure of claim 1, wherein the flap is provided with a diaphragm which, in the downward tilted closing position of the flap, lies in front of a mouth of the puncturing channel and is adapted to be punctured by the puncturing pipe.

12. The closure of claim 11, wherein the puncturing channel is substantially cylindrical, and that the diaphragm is circular with a diameter corresponding to a clear width of the puncturing channel.

13. The closure of claim 12, wherein the diaphragm is provided with radially extending predetermined breaking locations equally spaced along a circumference.

14. The closure of claim 1, wherein a rim of a diaphragm has a predetermined breaking location with webs of a hard component and intervening parts of a seal component.

15. The closure of claim 1, integrally manufactured in one step by three-component assembling injection moulding.

* * * * *